United States Patent [19]

Conley, Jr. et al.

[11] Patent Number: 4,603,647

[45] Date of Patent: Aug. 5, 1986

[54] SEWING MACHINE WITH EDGE TRIMMER

[75] Inventors: Ralph F. Conley, Jr., Miamisburg; Ricky F. Frye, Waynesville, both of Ohio

[73] Assignee: MIM Industries, Inc., Miamisburg, Ohio

[21] Appl. No.: 691,430

[22] Filed: Jan. 14, 1985

[51] Int. Cl.[4] ..... D05B 65/02

[52] U.S. Cl. ..... 112/129; 112/34; 112/199

[58] Field of Search ..... 112/288, 122, 130, 129, 112/197, 199, 34 T, 53, 123 R, 126

[56] References Cited

U.S. PATENT DOCUMENTS

| | | | |
|---|---|---|---|
| 2,229,991 | 1/1941 | Sauer | 112/288 |
| 3,818,851 | 6/1974 | Marforio | 112/130 |
| 3,871,308 | 3/1975 | Galya et al. | 112/122 |
| 3,881,434 | 5/1975 | Kelly | 112/199 X |
| 4,098,209 | 7/1978 | Schopf | 112/199 X |
| 4,502,400 | 3/1985 | Walther | 112/122 |

*Primary Examiner*—Werner H. Schroeder
*Assistant Examiner*—Andrew M. Falik
*Attorney, Agent, or Firm*—Donald P. Gillette

[57] ABSTRACT

A chainstitch machine has an edge trimmer knife driven in vertical chopping motion adjacent the needle by a linkage actuated by an oscillating shaft that operates synchronously relative to stitch-forming components. The linkage includes a bracket oscillated by the shaft and a joint movable along the bracket between a first position, in which the axis of the joint is offset from the axis of the shaft to communicate oscillating movement to the knife, and a second position, in which the axis of the joint is concentric with the shaft and transmits no oscillatory movement. In the second position, the knife is retracted by the linkage to a location above the region through which work pieces move, but in the first position, the linkage moves the knife down so that part of the knife extends through the plane of the throat plate and is pressed against an edge of a throat plate insert by a small pressure slide entirely within a notch in the insert and guided by juxtaposed edges of the notch. The chain of stitches between each pair of work pieces is cut by a rotary knife blade cooperating with a fixed blade between front and back sections of the feed dog to be close to the stitch-forming location.

7 Claims, 5 Drawing Figures

SEWING MACHINE WITH EDGE TRIMMER

This invention relates to sewing machines with edge trimmers and particularly to a chainstitch machine with a high-speed synchronized knife-actuating structure and a simplified throat plate that responds quickly to trimming movement of the knife.

One type of specialized sewing machine used in industrial sewing is a chainstitch machine with a trimming knife for cutting away excess material close to the point at which stitches are being formed. A particular example is a machine that used to be made by the Union Special Machine Co. as their Model 9500G but is no longer being manufactured. However, some Model 9500G machines are still used for performing back seam closing and side seams closing operations in the production of shoes. The stitch configuration generated by the Model 9500G is a two-thread chainstitch Federal Stitch Type 401, and if the machine is in good condition, it is supposed to be capable of producing stitches at a rate of as many as 2800 per minute. In addition, the machine has a trimming knife that moves in a vertical chopping motion only 0.045" from the center of the stitch holes made by the needle. The machine also has provisions for both top and bottom feeding devices and for lifting the knife up to an inoperative position when trimming is not required.

In the following description the directional terms "vertical", "horizontal", "up", "down", "back", and "front" will be used. Those terms will be used with respect to the most common position of sewing machines in which the needle moves vertically down into the material being sewn, or work piece, and then up out of it. The front of the machine is the side faced by the operator when the vertical arm of the machine is on the operator's right and the needle on the left. While the needle moves along an inclined path in some machines, in most it moves vertically. In any case, the listed words are used only for convenience of description of the invention. They apply to a preferred embodiment of the invention, but they should not be construed as limitations of the invention.

The cutting edge of the knife in the Model 9500G is not formed along one of the longer sides of the blade but is located at the lower end, where it is approximately parallel to the surface of the throat plate when the knife is installed on the machine. The cutting edge is not more than a few stitches long, and it extends parallel to the direction of motion of that part of the material that is receiving a stitch. Although the line of stitches may be curved, each stitch is tangent to the curve, and the cutting edge of the knife is parallel to the tangent but displaced a short distance to the side of it.

The throat plate, as is standard practice, has an opening through which a feed dog can move in order to propel the work piece into and away from the stitching location and it also has a needle hole. The throat plate of the Model 9500G has, on the opposite side of the needle hole from the feed dog opening, still another opening. The knife blade slides vertically along the wall that defines a guide edge of the latter opening to trim the work piece material in a punch-like straight-line motion rather than to cut the material in a scissors-like movement. In order to trim close to the stitch location, only a narrow bridge of throat plate material is left between the needle opening and the guide edge along which the knife slides.

If the knife blade were deflected toward the needle hole as it descended, the cutting edge would crash down directly against the surface of the narrow bridge. Such deflection could result from some graininess in the material being sewn and is prevented by forming the blade so that it has a slender finger of the blade material that extends far enough below the cutting edge to be below the upper surface of the throat plate at all positions of the oscillatory movement of the knife in its active trimming position. This allows the finger to be guided at all such times by the guide edge along which the finger and the blade of the knife must move. The finger, although slender, is much stronger than any force that could momentarily deflect the cutting edge over the part of the throat plate between the needle hole and the guide edge, and thus the finger prevents the cutting edge of the knife from crashing into the surface of the throat plate.

To make clean, sharp trimming cuts, the knife blade, as it moves up and down, must also be kept in contact with the guide edge but not by such great pressure as to cause excessive wear of either the edge or the knife blade. The Model 9500G has an arm pivotally mounted on the throat plate and having a small lateral plate extending from one edge at the outer end of the arm, as an axe blade extends from the handle. The plate is guided along its curved path by guide surfaces on the throat plate, and a spring acting on the arm urges it to pivot in a direction that causes the edge of the plate to press against the side of the knife blade near the cutting edge and thus to urge the knife blade against the guide edge. The pressure exerted against the knife blade is great enough to prevent its cutting edge from being deflected away from the guide edge, and thereby producing a rolled-over trimming of the material being sewn, but it is not great enough to wear the knife blade and the guide edge excessively.

At the lower part of each stroke, the end portion of the guide finger is in a region where stitches are being formed below the throat plate. This makes it necessary to synchronize the oscillations of the knife with the manipulations of the thread in that region and the Model 9500G has a mechanism that drives both the knife and a looper, which operates in the stitch-forming region, to keep the knife and the looper in synchronism with each other.

The knife must also slice into the work piece when the latter is lying still on the throat plate and is not moving forward under the intermittent force of the feed dog. That requires that the knife operate synchronously with the needle to move downward simultaneously with the needle, since it is while the needle is penetrating the work piece that the work piece is not being moved forward by the intermittent force of the feed dog.

It is common in chainstitch machines to provide a small finger mounted below the throat plate close to the needle hole to act as a spreader in forming each stitch. In the Model 9500G such a spreader is mounted on the under side of the throat plate, itself, and in order to adjust the precise location of the spreader, as is necessary from time to time, the screws holding the throat plate in place on the frame of the machine must be removed to allow the throat plate to be removed. Then the set screw that holds the spreader can be loosened to allow the spreader to be moved to what the person making the adjustment guesses should be the correct location. After that, the set screw can be tightened to hold the spreader firmly, and the throat plate can be turned back over and screwed into place. If the guess was correct, which the operator can only find out by making some experimental stitches, the machine can be used in production, but if the experimental stitches show that the position of the spreader is not correct, the whole process must be repeated. The Model 9500G has no means for positioning the spreader with reference to the needle or the looper.

One of the objects of this invention is to provide a substantially higher speed chainstitch machine with a convenient means to control an edge trimmer so that it can be shifted between an operative position, in which it will be in the path of the material being sewn, and an inoperative position far enough above the bed of the machine to be out of the path of the material. The same control that shifts the position of the knife also shifts part of its driving linkage so that, in the operative position, the knife moves with a chopping motion that is synchronous with the formation of stitches while, in the inoperative position, the knife stays virtually motionless.

Another object is to simplify the manufacture of the throat plate of such a machine and to make it easier to adjust the stitch-forming components.

A further object is to provide means for automatically severing the chain of threads that joins each sewn work piece to the next one about to be sewn.

It is another object of this invention to provide an industrial chainstitch sewing machine that has the foregoing features and is capable of operating at a speed of 3400 stitches per minute or even higher.

Further object will be apparent from the following description together with the drawings.

In accordance with this invention, a chainstitch machine is provided with actuating linkage that includes an oscillating drive shaft driven from the same motor that drives the stitch-forming components so that the oscillations of that drive shaft will be synchronous with the movement of those components. A further part of the actuating linkage is attached to the sewing head and is driven by the oscillating drive shaft to drive a knife positioned for vertical sliding movement very close to the needle of the machine.

The linkage includes a joint that can be moved manually or by power-operated means between an inoperative position and an operative position. In the former, the joint is in line with the axis of the oscillating drive shaft, while, in the latter, the joint is displaced from axial alignment with the drive shaft to a position along a bracket connected to the drive shaft to oscillate with it whenever the machine is in operation.

The joint is connected to the knife via other linkage members controlled by the joint to lift the knife away from the throat plate to a position in which it has no effect on material being sewn when the joint is moved into axial alignment with the drive shaft. Conversely, when the joint is shifted to its operative position, the linkage members move the knife down close to the throat plate and transmit an oscillatory up-and-down movement to the knife in direct response to pivotal oscillations of the drive shaft.

The opening into which the cutting edge of the knife descends slightly must not be allowed to remain open. The present invention eliminates the pivotally mounted arm used on the Model 9500G and provides, instead, a small plate that slides perpendicularly with respect to the direction of motion of the feed dog and is spring-biased toward the guide edge on the throat plate and the finger on the knife. The surface of the finger that faces the sliding plate pushes the sliding plate away from the guide edge, thereby widening the opening enough to allow the cutting edge of the knife to slice downwardly through a work piece without engaging the sliding plate. The sliding plate is guided in a notch on a thin, fixed plate that is rigidly attached in a shallow, relatively wide slot in the upper surface of the throat plate. It is the end of the notch in the thin fixed plate that forms the guide edge along which the knife blade slides.

The arrangement of the throat plate with its small sliding plate makes it possible to insert a photosensitive device in a position to be actuated by each work piece so as to control the operation of a second knife that can be used to cut the chain of stitches between each work piece and the next. This facilitates the use of automatic machines to remove each finished work piece without requiring the operator to stop and cut each chain of stitches by hand.

Further in accordance with the present invention, a spreader is not mounted directly on the throat plate but, instead, is mounted on a plate that supports the throat plate. This allows the position of the spreader to be adjusted directly with reference to the needle and the looper when the throat plate is removed. Replacement of the throat plate after the adjustment does not risk mispositioning the spreader.

FIGS. 1, 2, and 3 are, respectively, front, top, and side views of a sewing machine that incorporates the invention.

Figure 1:
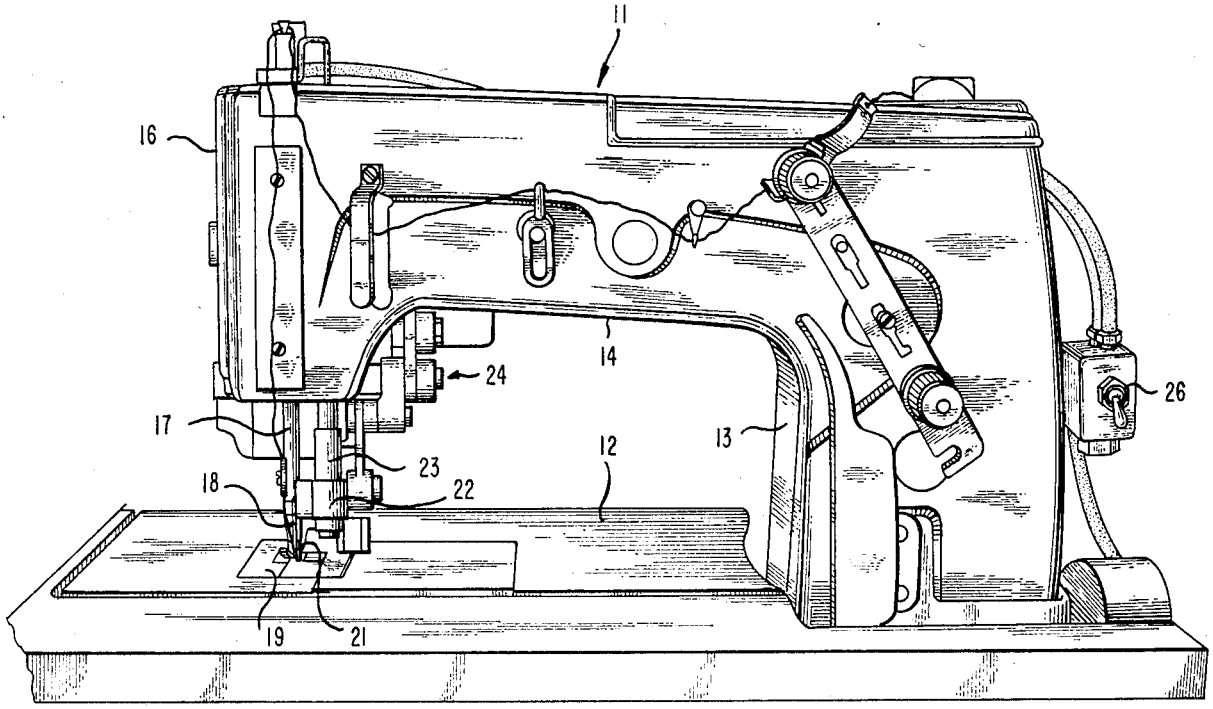

The machine 11 shown in FIG. 1 is a chainstitch machine that has a bed 12, an upright arm 13, and a horizontal arm 14 with a sewing head 16 at its free end. A needle bar 17 that supports a needle 18 at its lower end is mounted in bearings in the head so as to be able to move freely up and down, and directly below the head is a throat plate 19 that has a flat upper surface coplanar with the upper surface of the bed 12.

The throat plate 19 has novel features that will be shown in other figures, but the other components enumerated in the preceding paragraph are basically standard on chainstitch machines. In addition, the machine 11 includes a trimming knife 21 rigidly attached to a clamp 22 that slides on a vertical shaft 23 parallel to the needle bar 17. The shaft 23 does not move, but the clamp 22 is caused to move up and down on the shaft 23 by force transmitted through actuating linkage components 24.

The linkage components 24 can be seen more clearly in FIG. 4, which will be described later; at the moment it is sufficient to note that the clamp 22 is near the bottom of the shaft 23, which means that the knife 21 is in its active, or trimming, position. The linkage components 24 can be shifted to move the clamp 22 up on the shaft 23 so that the knife will be elevated above the throat plate 19 and placed in its inactive position, high enough above the throat plate to allow work pieces moving along the surface of the throat plate to pass under the knife without touching it. Such repositioning of the clamp is controlled by a toggle switch 26, which, for convenience, is mounted on the upright arm 13.

Figure 2:
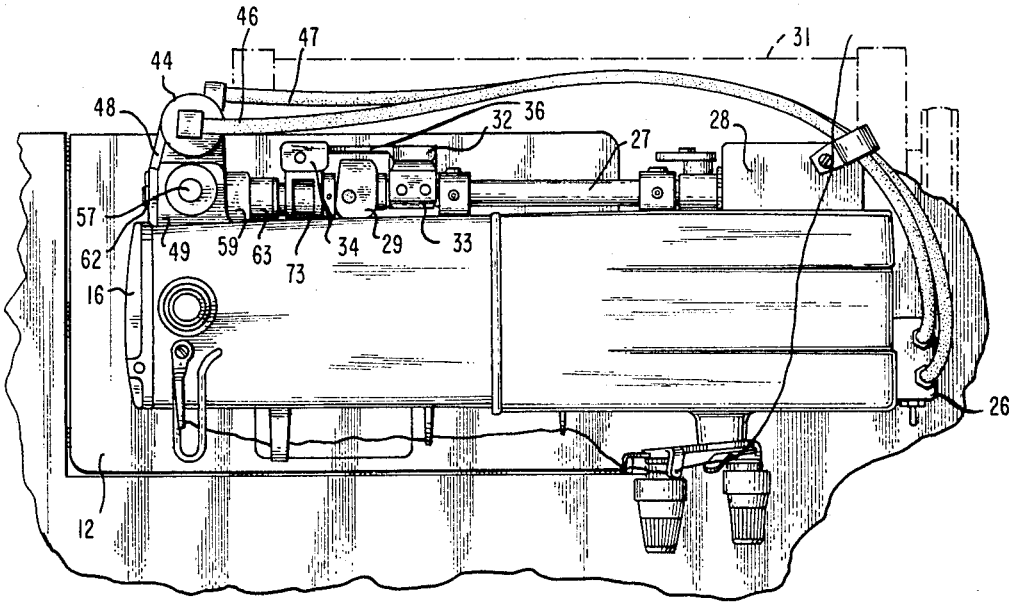
Figure 3:
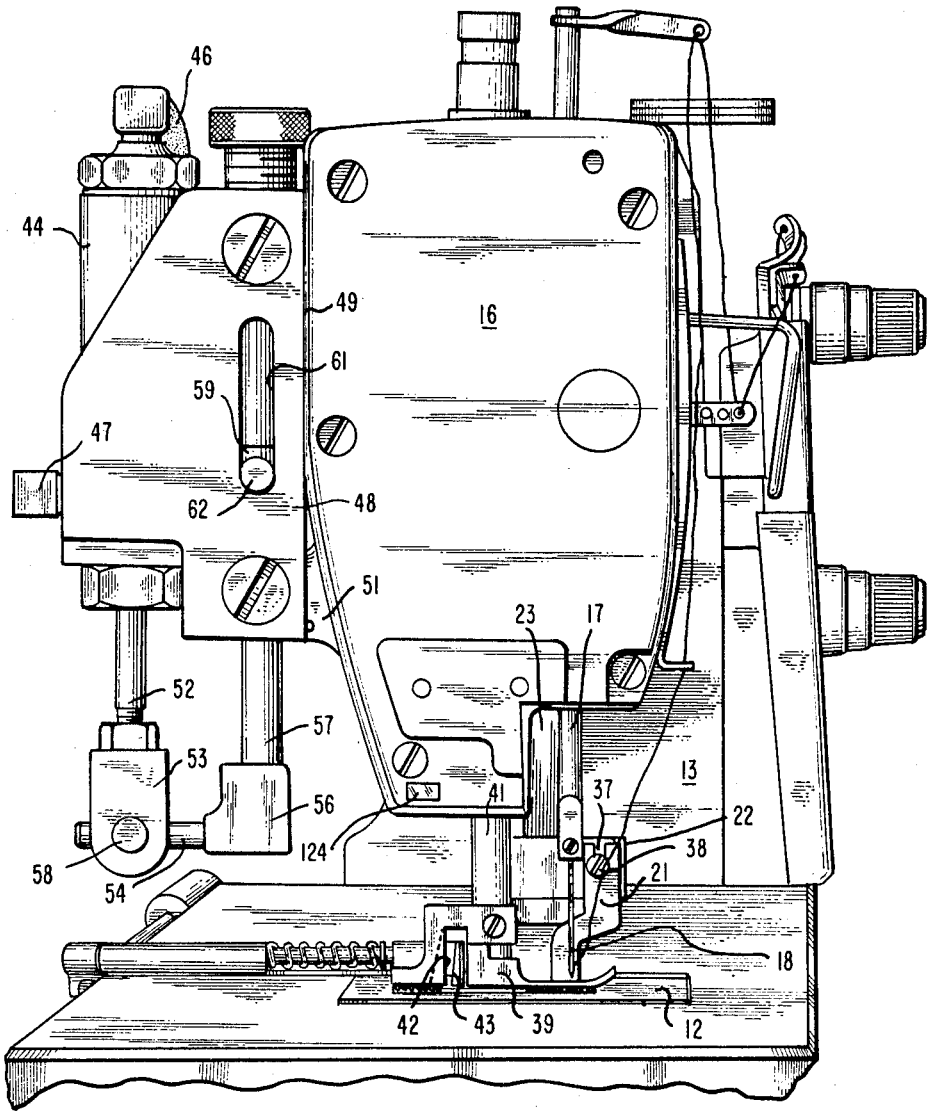

FIGS. 2 and 3 show some of the components hidden behind the machine 11 in FIG. 1. One of these components is a shaft 27 that is part of the actuating linkage to supply force to drive the knife up and down in its trimming mode. As may be seen in FIG. 2, the shaft 27 is rotatably held in bearings in two supports 28 and 29. The bearing support 28 is really an enclosure cast as part of the back of the upright arm 13, and within the enclosure, the shaft 27 is connected to an oscillatory power take-off mechanism that may be of a standard type such as the mechanism that supplies oscillatory, or reciprocating, movement to the bar 17 that supports the needle 18. Both the needle bar 17 and the shaft 27 are powered by the same motor 31, which is shown only partially and in dotted lines. As is true of most sewing machines, the motor 31 also drives other parts of the stitch-forming mechanism, causing all of the stitch-forming components, as well as the shaft 27, to operate synchronously with respect to each other. All of these components, including the shaft 27, carry out an oscillatory movement, although not all of the components are in motion at the same instant. In the case of the shaft 27, its oscillatory movement is a pivotal one of a few degrees alternately clockwise and counterclockwise about its axis.

A member in the form of a bracket 32 is rigidly connected to the shaft by two short arms 33 and 34 that encircle the shaft on opposite sides of the bearing support 29 and are joined together by a member 36 in the form of a bar that extends parallel to the shaft 27 outwardly of the support 29. The rigid connection between the shaft 27 and the bracket 32 causes all parts of the bracket to undergo exactly the same type of oscillations as the shaft, but those oscillations cannot be visualized as well as they can in FIG. 4, which will be described later.

FIG. 3 shows that the knife 21 is held in a shallow slot 37 on the clamp 22 by a screw 38. The lower part of the knife 21 is offset from the upper part and is located directly behind the needle 18 so that trimming cuts made by the cutting edge of the knife at its lower end are directly alongside the needle.

The toe portion of a presser foot 39 is also in the same region and includes a needle hole that cannot be seen in FIG. 3 but is directly in line with the path of the needle 18. The presser foot is clamped to the lower end of a spring-biased presser bar 41, and in the lower surface of the presser foot, just to the left of the presser bar, is a recess 42 that provides operating space for a pivotally mounted knife blade 43. The purpose of this blade is to sever chains of stitches that join each work piece to the next as those work pieces move from right to left (in FIG. 3) under the presser foot 39. The knife blade 43 and other components that are closely associated with it will be set forth in greater detail in connection with figures yet to be described. At the moment it is sufficient to note the location of the pivotally mounted knife blade 43 relative to the presser foot 39.

The knife blade 43 is not needed on every job and may be omitted in some models of the machine 11. If it is omitted, a different, and simpler, presser foot that does not have a recess like the recess 42 may be used.

When the knife 21 is not to be used in trimming work pieces, the clamp 22 is moved up on the shaft 23 to a position just below the lower surface of the head 16, thereby moving the knife up to its inoperative position in which material being sewn will pass under the knife without being touched by it. The shifting of the clamp and knife from one position to the other can be accomplished by power supplied by a pneumatic cylinder 44 shown on the left side of FIG. 3 and also on the left side of FIG. 2. As is customary, the cylinder 44 has a piston inside it to be moved toward one end of the cylinder or the other by the difference in air pressure supplied by pneumatic lines 46 and 47 that are most clearly visible in FIG. 2. The pneumatic lines are connected to the switch 26, which can be actuated to connect either line to a source of higher pressure air and the other line to air at lower pressure, thereby creating the necessary pressure differential to drive the piston to one end of the cylinder 44 or the other.

As is most clearly visible in FIG. 3, the cylinder is mounted on a bracket 48, which is rigidly mounted on journal bearing supports 49 and 51 that extend from the rear of the sewing head 16. A connecting rod 52 connected to the piston in the cylinder extends below the bracket 48 and carries a clevis 53 at its lower end. A dowel 54 rigidly held in a connector 56 at the lower end of a vertical shaft 57 engages a pin 58 in the clevis so that the connecting rod 52 and the shaft 57 move as a unit.

The supports 49 and 51 have aligned journals that allow the shaft 57 to move only in the vertical direction, and a block 59 is rigidly attached to the shaft to move therewith. Only a small part of the block 59 is visible through a vertical slot 61 in the bracket 48, and a manual control member in the form of a dowel 62 firmly inserted in the block 59 extends through the slot 61. The dowel 62 allows the block 59 to be lifted manually when there is no air applied to the cylinder 44.

Figure 4:
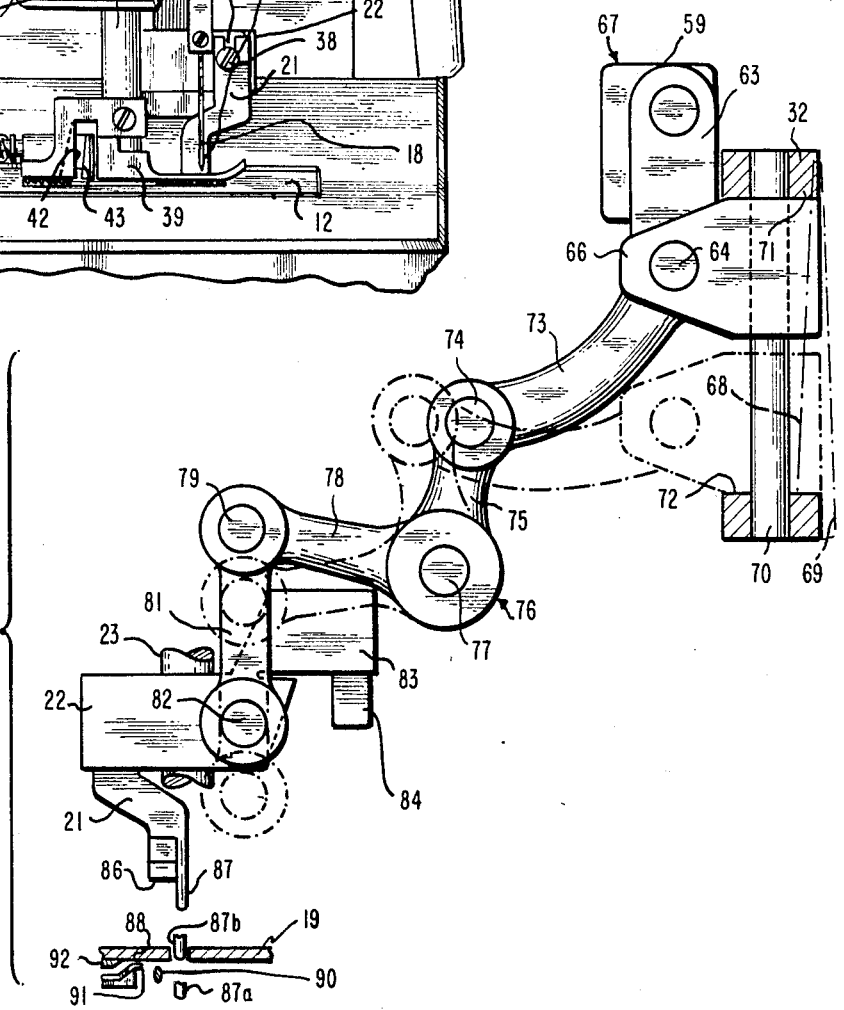
FIG. 4 shows the trimming knife of FIGS. 1 and 3 and some of the stitch-forming components and knife-controlling linkage components.

As is shown in FIG. 4, the block 59 is connected by another connecting rod 63 to an axle 64 in a clevis 66 that is one of the components in the actuating linkage 24. The position of the actuating linkage and the knife 21 in either their operative or inoperative positions is controlled by another linkage, which will be referred to as a control linkage 67 and which, in this embodiment, includes the connecting rod 63, the block 59, the shaft 57 and its connector 56, the dowel 54, the clevis and its pin 58, and the connecting rod 52. These are the components that link the cylinder 44 to the actuating linkage components 24.

In FIG. 4 the actuating linkage components are shown in solid lines in their inoperative position and in broken lines in their operative position. The linkage components include the bracket 32 that, as noted in connection with the description of FIG. 2, is rigidly attached to the shaft 27 that pivots back and forth a small angular amount. Although the shaft does not appear in FIG. 4, its axis is the same as the axis of the axle 64 in the upper position, and the small pivoting oscillations of the shaft 27 and the bracket 32 are illustrated by dotted lines 68 and 69. The clevis 66 is slidably mounted on a round shaft 70 rigidly held by two spaced stops 71 and 72 that are parts of the bracket 32. The clevis 66 is against the upper stop 71 in the inoperative position and against the lower stop 72 in the operative position.

The axle 64 through the clevis 66 also passes through one end of a link 73, the other end of which is connected by an axle 74 to one arm 75 of a bell crank lever 76. The lever is pivotally mounted on a fixed axle 77 that is supported by the sewing head 16 in FIG. 1 so as to be parallel to the shaft 27 and at a fixed distance from it. The bell crank lever 76 has another arm 78 perpendicular to and longer than the arm 75, and at the outer end of the arm 78 an axle 79 through it and through one end of a connecting member 81 connects the latter member and the bell crank lever together. The lower end of the connecting member 81 is joined by yet another axle 82 to the clamp 22 on which the knife 21 is mounted. The clamp has an extension 83 with a slotted end that embraces a vertical guide 84 mounted rigidly on the sewing head 16.

When the clevis 66 is in its upper, inoperative position as shown in solid lines, the fact that the bracket 32 pivots about the axis of the axle 64 means that the axle will simply pivot back and forth in the link 73 without transmitting any linear movement to the link. All of the other members making up the actuating linkage components 24 also remain stationary in the absence of any longitudinal movement of the link 73.

In order to shift the actuating linkage components 24 to their operative position, the control linkage 67 pushes the block 59 and the connecting rod 63 down, thereby moving the clevis 66 away from its inoperative position against the upper stop 71 and downward until it reaches its operative position against the lower stop 72. In the latter position the link 73 is subjected to longitudinal movement as the bracket 32 oscillates back and forth between the limit positions indicated by the dotted lines 68 and 69.

Moving the clevis 66 against the lower stop 72 also causes the link 73 to push the arm 75 to the left (as shown in FIG. 4). This rotates the bell crank lever 76 counterclockwise and causes its arm 78 to push the connecting member 81 downwardly on the shaft 23. This movement of the clamp carries the knife 21 with it to its operative position.

The knife 21 performs its trimming operation in much the same way that a hole punch forms holes in a piece of paper: it moves straight down against the work piece, which is held by the throat plate so that it cannot move with the knife. This does not mean that the knife can move directly against the throat plate: it has to move past an edge of the throat plate into an open space, and the part of the work piece on the solid throat plate is the part of the work piece that is supported, but the adjacent part of the work piece that is over open space is severed from the supported area.

It is apparent that the cutting edge 86 of the knife cannot be very long, and it is, in fact, no more than a few stitches long. The knife in this embodiment is synchronized to make a trimming stroke with each stitch and, therefore, the cutting edge can be as short as a stitch. It will be noted that the knife is formed with a finger 87 extending beyond the cutting edge 86 at the end of the cutting edge toward which work pieces move as they are trimmed. The purpose of the finger is to prevent the knife from being deflected either away from or toward the edge of the throat plate along which it must slide as it chops down through the material being trimmed. Such deflection, which would be perpendicular to the plane of the drawing in FIG. 4, could be caused by graininess in a work piece, and it could either produce a destructive collision between the knife 21 and the throat plate 19, or it could result in a rolled-over cut rather than a clean one.

The finger 87 extends at least below the upper surface of the throat plate 19 when the knife is in its operative position and all of the linkage components 24 are also in their operative positions shown in broken lines. In order not to clutter FIG. 4 to the point of illegibility with too many lines, the knife 21, including its guide finger 87, is shown in full in its uppermost, inoperative position, and the finger, alone, is shown in the two positions **87*a* and 87*b* representative of the maximum movement during a trimming operation. Those positions correspond, respectively, to the positions of the bracket 32 as represented by the dotted lines 68 and 69. It will be noted that, throughout the excursion of the knife 21 during a trimming stroke, the finger 87 is in position to engage an edge of the throat plate 19 and be guided thereby to guide the cutting edge 86 along that edge of the throat plate. A small slide 88 in the throat plate 29 is spring-biased against the knife to urge the finger 87**, which will henceforth be referred to as a guide finger, against the edge of the throat plate.

One of the elements required in chainstitch machines is a slender rod-like member positioned under the throat plate and moved about in such a way that it enters and takes over the loop of thread formed near the eye of the needle. This loop-taker, or looper, as it is commonly called in chainstitch machines, then spreads the loop apart to allow the needle to enter it on the next stitch. The looper 90, which is shown only in cross-section in FIG. 4, carries out its loop-spreading operation very close to the underside of the throat plate in a region that can be entered by the knife 21 at a certain point in each reciprocating movement of the knife. It is to prevent any interference between the knife and the stitch formation that the knife must operate synchronously with the stitch-forming devices.

Figure 5:
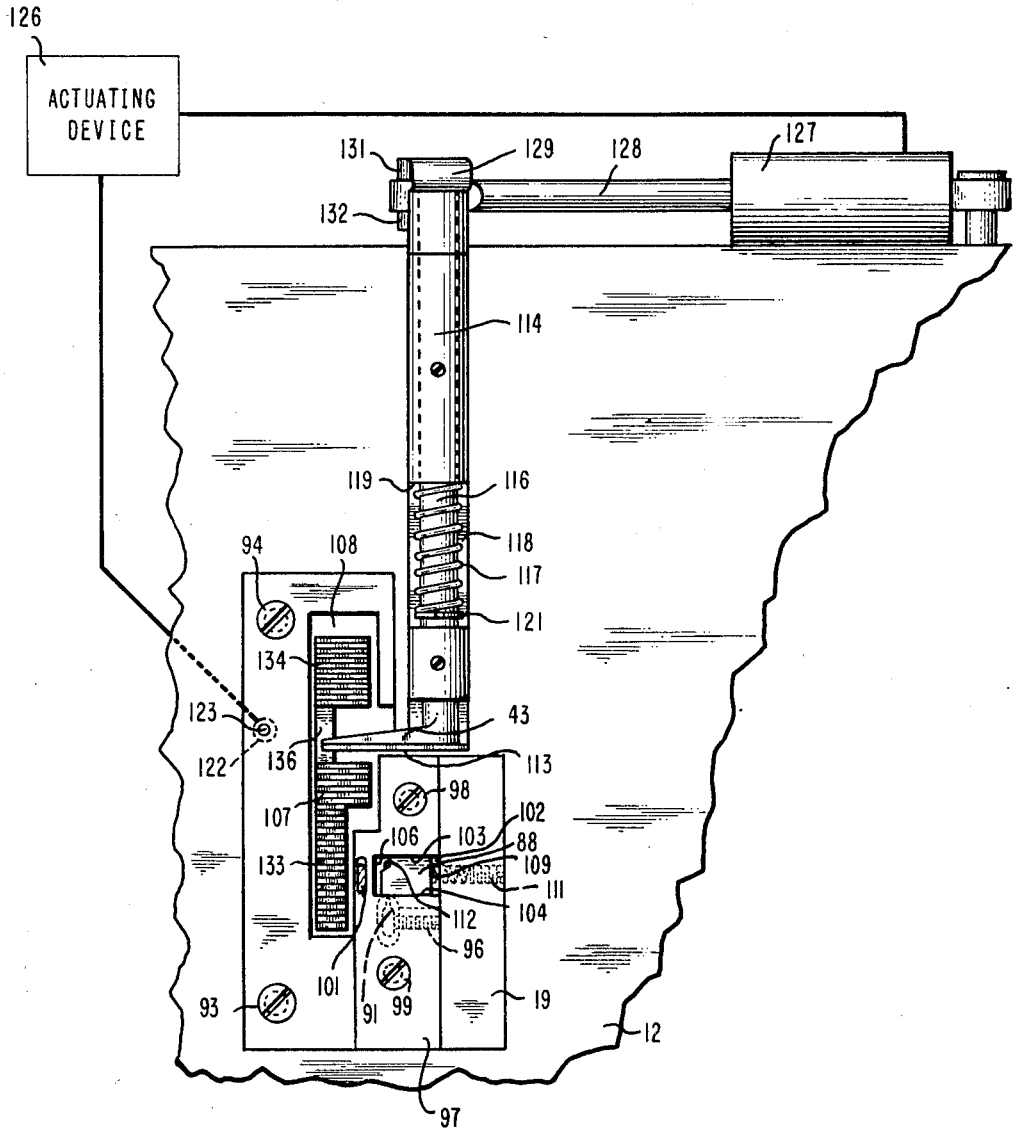
FIG. 5 shows the throat plate and another knife for the machine in FIGS. 1–3.

FIGS. 4 and 5, considered together, show some of the other components in the stitch-forming region. One of these components is a tiny rod-like member 91 called a loop retainer, or spreader. It has to be fixedly positioned very precisely so that, at one time in the formation of each stitch, a thread loop can be placed on the retainer 91 to facilitate having the needle enter the loop. Then, it must be possible to remove the loop from the retainer easily at a certain later time in the formation of the stitch.

The retainer in Model 9500G machine was held firmly against the underside of the throat plate by a holding screw. This allowed the retainer to be placed initially in its proper position and to be returned to that position if usage of the machine shifted location of the retainer. However, this meant that in order to adjust the retainer when it got out of position, the throat plate had to be removed by loosening the screws holding it on the machine, and then the retainer had to be moved, after which the throat plate had to be placed back on the machine. The problem was that the correct position of the retainer is related to the needle path and the looper path, and this relation could not be observed or tested in the Model 9500G until after the throat plate had been screwed back on the machine.

The problem of positioning the retainer in the present machine is minimized by supporting the retainer 91 on a support plate 92 that is rigidly attached to the frame of the machine. As may be seen in FIG. 4, the support plate 92 is under the throat plate 19 to support the latter, and part of the throat plate in the region of the retainer is cut away so that the retainer can extend into its required position relative to the needle 18 and the looper 90. As a result, even when the machine screws 93 and 94 that hold the throat plate on the support plate are removed to allow the throat plate 19 to be lifted up to reposition the retainer 91, the retainer will remain rigidly attached to the support plate 92. The retainer is held in position by a set screw 96 in the support plate and, when the set screw is loosened, the fact that the throat plate has been removed leaves the retainer 91 clearly visible adjacent the path of the needle 18 and the looper 90 to facilitate accurate adjustment of the position of the retainer. This adjustment is not at all affected by returning the throat plate 19 to the position shown in FIG. 4 and putting the screws 93 and 94 back in.

The throat plate 19 has an insert 97 held in a shallow slot in the upper surface of the throat plate by two machine screws 98 and 99. The slot is machined to allow the insert to fit snugly in it with the upper surface of the insert coplanar with the upper surface of the throat plate 19. When the insert and the throat plate are so assembled, they constitute, in effect, a unitary throat plate structure with a needle hole 101 in the insert. The insert has a notch 102 with parallel guide edges 103 and 104 along its sides to guide the small slide 88. The inner end of the notch forms the straight edge 106 along which the guide finger 87 and, to a limited extend, the cutting edge 86 of the knife 21 slide in carrying out each trimming stroke. The straight edge 106 extends parallel to the motion of a feed dog 107 that periodically extends up through another opening 108 in the throat plate 19. The feed dog and its opening are, for the most part, on the far side of the needle hole 101 from the notch 102, but both the feed dog and its opening widen out toward the rear of the bed 12 of the machine.

The throat plate 19 has a spring 109 to apply pressure to the small slide 88 to push the slide toward the edge 106. The pressure applied by the spring can be adjusted by a set screw 111, and it is set to a pressure sufficient to press the surface of the knife 21 firmly enough against the edge 106 to produce clean trimming cuts but not so firmly as to cause too much wear on the edge 106 or the knife 21. It will be noted that the small slide 88 has a notch 112 in one corner aligned with the guide finger 87 to allow the guide finger to enter when the knife is moved from its inoperative position.

FIG. 5 also shows apparatus for actuating the pivotally mounted knife blade 43 in FIG. 3. As shown from above in FIG. 5, the knife blade 43 is actually like one blade of a pair of scissors and cuts by cooperative action with another blade 113. The latter is held stationary on a support 114 and the knife 43 is mounted on the end of an axle 116 pivotally mounted in the support 114. A compression spring 117 encircling the axle and located in a gap 118 in the support 114 presses against one face 119 of the gap and against a snap ring 121 on the axle 116 to apply axial pressure that resiliently urges the blade 43 against the blade 113 to maintain proper scissoring action.

The support 114, in turn, is rigidly attached to the machine flat along the bed 12 or in a shallow slot with the axis of the axle 116 parallel to the direction of feeding movement of the feed dog 107 so that the blades 43 and 113 extend substantially perpendicularly to the axle 116.

The purpose of the scissors comprising the blades 43 and 113 is to sever the chain of stitches formed between each work piece and the next. To make sure that the blade 43 is pivoted as a finished work piece passes a certain point, a small photosensitive device 122 is mounted on the under side of the throat plate 19 to receive light through a small hole 123 in the throat plate. The light may be ambient light but is preferably supplied by a small lamp 124 shown mounted on the sewing head 16 in FIG. 3.

Light from the lamp 124 cannot reach the photosensitive device 122 while a work piece is being moved along by the feed dog 107, but as the completed work piece is moved beyond the stitching region by the operator, the work piece moves out of the light path, and the photosensitive device 122 can again be energized by light from the lamp 124. The photosensitive device produces a certain type of signal when it changes from the condition of being in shadow to the condition of being illuminated, and a well-known type of circuit, symbolically represented by the box 126 labelled "Actuating Device", is connected to the photosensitive device 122 to respond to that by producing an actuating signal connected to a mechanical actuator 127, which is located at the back of the bed 12 in this embodiment.

The actuator may be a solenoid or a pneumatic cylinder but, in any case, must respond quickly to the actuating signal. Depending on the mechanical arrangement of components connecting the actuator to the axle 116, the required response may be either to cause the shaft 128 to be pulled suddenly into the actuator 127 and immediately thereafter returned to the position shown in FIG. 5, or to cause the shaft 128 to execute a sudden excursion and return in the opposite direction. In the embodiment in FIG. 5, the shaft 128 is connected to a clevis 129 rigidly attached to the end of the axle 116. The clevis has short, parallel arms 131 and 132 that extend generally downwardly relative to the plane of the bed 12 of the machine, and when the shaft 128 is suddenly pulled into the actuator 127, the axle 116 is pivoted to move the blade 43 suddenly to a closed position with respect to the fixed blade 113, thereby severing any chain of stitches that may be between the blades. Due to the rapidity with which successive work pieces are sewn, the actuating signal from the actuator 127 must be of short duration to reverse the movement of the shaft 128 quickly enough to pivot the blade 43 back up out of the path before the next work piece arrives.

The serrated feeding surface of the feed dog 107 is divided into front and back parts 133 and 134, respectively, both of which extend from the feed dog frame 136, which is below the level of the serrated surfaces. This allows the fixed blade 113 and part of the support 114 to extend across the frame 136 between the parts 133 and 134. The parts 133 and 134 are spaced far enough apart to avoid hitting the blades 43 and 113.

It should be noted that the machine 11 has an upper feed device directly over the feed dog 107. Such upper feed devices are well known, and the one available for the machine 11 is not shown because it would make the drawings unnecessarily complex and unclear.

What is claimed is:

1. In a chainstitch machine that includes a looper, a looper support, a needle, a needle support to support the needle for reciprocating motion carrying a first thread along a needle path toward and away from the looper as the looper carries a second thread in repetitive oscillations in a looper path close to the needle path, driving mechanism common to both the needle support and the looper support to supply oscillatory force to both of the supports synchronously to form chain stitches of the threads at a stitch-forming location, a knife, and a guide structure to guide movement of the knife close to the needle path and toward the looper path, the invention comprising:

a. an actuating linkage connecting the knife to the driving mechanism and comprising:

(i) a drive shaft oscillating about its axis,
(ii) a bracket extending in a generally lateral direction from the drive shaft,
(iii) a joint having an axis parallel to the axis of the shaft, the joint being movable along the bracket between a first location, in which the axis of the joint is offset from the axis of the drive shaft, and a second location, in which the axis of the joint is substantially closer to the axis of the shaft, the first location corresponding to the operative position of the actuating linkage and the second location corresponding to the inoperative position of the linkage, and
(iv) connecting means connecting the joint to the knife; and b. control means connected to the actuating linkage to shift the actuating linkage between an operative position, in which the knife is positioned in a trimming location close to the throat plate and the actuating linkage transmits to the knife a reciprocating trimming force that has a predetermined magnitude and is synchronous with the oscillatory force supplied to the needle support and that causes a portion of the knife periodically to enter the stitch-forming location, and an inoperative position in which the knife is retracted from the throat plate and the actuating linkage transmits to the knife a reciprocating force that has a magnitude substantially less than the predetermined magnitude of the trimming force.

2. The invention according to claim 1 in which the connecting means comprises:
a. a first connecting rod;
b. a lever mounted to pivot on an axis parallel to and fixedly spaced from the axis of the shaft, the lever comprising first and second arms, the first connecting rod connecting the joint to the first arm; and
c. a second connecting rod connecting the second arm of the lever to the knife.

3. The invention according to claim 1 in which the needle support and the guide structure are on one side of the throat plate and the looper is on the opposite side of the throat plate and:
a. the knife comprises:
(i) a cutting edge substantially parallel to the throat plate when the knife is in its active position, and
(ii) a guide finger extending beyond the cutting edge;
b. the throat plate comprises:
(i) a needle hole surrounding the needle path, and
(ii) a trimming edge aligned with the guide structure, extending past the throat plate and being guided by the trimming edge when the knife is in its active position, the guide finger being spaced from the throat plate and on the same side of the throat plate as the guide structure when the knife is in its inactive position.

4. The invention according to claim 3 in which the throat plate comprises:
a. a feed dog opening;
b. a slot alongside the feed dog opening, the slot having a width much greater than its depth;
c. an insert plate in the slot, the thickness of the insert plate being substantially equal to the depth of the slot, and the width of the insert plate being substantially equal to the width of the slot, the insert plate being rigidly mountable in the slot to serve as a rigid part of the throat plate, the insert plate having a substantially rectangular notch defined by guide surfaces forming the sides of the notch, and a straight end edge perpendicular to the sides, the straight end edge comprising the guide edge of the throat plate;
d. a throat plate pressure slide held and guided in the notch by the guide surfaces and having an end surface that faces the guide edge, the end surface having a guide finger notch therein; and
e. spring means to urge the throat plate pressure slide toward the guide edge.

5. In a chainstitch machine that is capable of forming a chain of stitches in and between work pieces and includes a bed having an upper surface, a looper below the level of the surface of the bed, a needle support to support a needle for reciprocating motion along a needle path toward and away from the looper, driving means to drive the looper and the needle support in synchronism with each other, a throat plate between the looper and the needle support, a knife that is mounted for reciprocating motion along a path and that has a cutting edge substantially parallel to the throat plate, and a feed dog opening in the throat plate, the invention comprising:
a. a shallow, straight-sided slot in the surface of the throat plate facing the needle support, the width of the slot being many times greater than the depth thereof;
b. a throat plate insert held rigidly in the slot and comprising straight, parallel sides and a needle hole directly in line with the needle path;
c. a notch extending into the insert from the edge on the opposite side of the needle hole from the feed dog opening, the notch having straight, parallel sides extending perpendicularly into the insert from one of the straight sides thereof and comprising guides and having an end guide edge adjacent the needle hole, the portion of the insert between the guide edge and the needle hole defining a narrow bridge, the knife being movable perpendicularly to the throat plate into and out of an active position and being movable reciprocatingly along the guide edge when the knife is in its active position;
d. a throat plate pressure slide engaging the parallel guides along the sides of the notch to be guided thereby to move perpendicularly to the knife, the length of the slide in the direction of its movement being less than the length of the straight, parallel sides of the notch; and
e. biasing spring means to bias the slide toward the guide edge when the knife is in its active position.

6. The chainstitch machine of claim 5 comprising:
support means to support the throat plate;
a loop retainer;
first means adjustably attaching the loop retainer to the support means in a selected fixed position relative to the needle path and the path of movement of the looper; and
second means, separate from the first means, for attaching the throat plate fixedly to the support means in a position to cover the fixedly positioned loop retainer and to be vertically spaced from the loop retainer, whereby chainstitch loops can be temporarily held by the loop retainer during part of the formation of each of the chain stiches.

7. The chainstitch machine of claim 5 comprising, in addition:

feed dog means mounted in the feed dog opening to move the work pieces along a predetermined path intersected by the needle path, the feed dog means comprising first and second parts spaced apart along the predetermined path;

a fixed knife extending transversely to the predetermined path and between the first and second parts of the feed dog means and sufficiently close to the level of the surface of the bed to permit the work pieces and the chain of stitches to pass over the fixed knife, the fixed knife having an upwardly facing cutting edge;

a pivotally mounted knife in scissoring engagement with the fixed knife;

an axle to support the pivotally mounted knife; and controllable means to pivot the pivotally mounted knife toward the fixed knife to sever the chain of stitches joining each pair of the work pieces together, said controllable means comprising:

a pneumatic cylinder, power means connected to the axle and to the cylinder to rotate the axle in response to actuation of the cylinder, photosensitive means mounted on the machine to be actuated by the change of the quantity of light that reaches it in response to movement of one of the work pieces across the photosensitive means, and actuating means connected to the photosensitive means to be controlled by it and connected to the power means to actuate it to pivot the axle and the pivotally mounted knife to sever a chain of stitches between each of the work pieces and the next work piece.

* * * * *